US005381579A

United States Patent [19]

Sartori

[11] Patent Number: 5,381,579

[45] Date of Patent: Jan. 17, 1995

[54] SURFACE-WIPING DEVICE

[75] Inventor: Francesco Sartori, Bologna, Italy

[73] Assignee: Firma Carl Freudenberg, Weinheim, Germany

[21] Appl. No.: 24,706

[22] Filed: Mar. 1, 1993

[30] Foreign Application Priority Data

Feb. 29, 1992 [DE] Germany ..... 4206376

[51] Int. Cl.[6] ..... A47L 13/144

[52] U.S. Cl. ..... 15/119.2; 15/116.2; 15/244.1

[58] Field of Search ..... 15/119.2, 244.1, 23, 15/24, 49.1, 50.3, 52, 98, 116.1, 116.2

[56] References Cited

U.S. PATENT DOCUMENTS

| | | | |
|---|---|---|---|
| 2,418,802 | 4/1947 | Bendar | 15/119.2 |
| 2,715,743 | 8/1955 | Ljungdahl | 15/119.2 |
| 2,750,613 | 6/1956 | Trindl | 15/119.2 |
| 2,977,619 | 4/1961 | Franzene | 15/244.1 |
| 3,157,901 | 11/1964 | Murphy | 15/119.2 |
| 3,172,138 | 3/1965 | Price | 15/98 |
| 4,137,592 | 2/1979 | Brown, Jr. | 15/119.2 |
| 4,439,885 | 4/1984 | Klotz | 15/119.2 |
| 4,654,920 | 4/1987 | O'Neil, Jr. et al. | 15/119.2 |
| 4,658,461 | 4/1987 | Roe et al. | 15/144.1 |
| 4,875,246 | 10/1989 | MacGregor | 15/119.2 |
| 5,097,561 | 3/1992 | Torres | 15/119.2 |

OTHER PUBLICATIONS

Abstract of DE-U-88 00 887, published in Germany May 5, 1988, filed Jan. 26, 1988 for a Cleaning Apparatus.

*Primary Examiner*—David A. Scherbel
*Assistant Examiner*—Patrick F. Brinson
*Attorney, Agent, or Firm*—Kenyon & Kenyon

[57] ABSTRACT

A surface-wiping device in which a compressible wiping member made of an absorbent material is mounted on a holder that is connected to a handle. The wiping member is affixed to a convex adhesive surface that surrounds a shaft. An roller is provided for squeezing liquid from the wiping member. This roller is pivotable about a shaft in response to the manipulation of a rod assembly that is attached to the handle.

16 Claims, 7 Drawing Sheets

SURFACE-WIPING DEVICE

BACKGROUND OF THE INVENTION

The invention relates generally to a surface-wiping device in which a compressible wiper member made of a fluid absorbent material is mounted on a utensil handle, and more particularly to a surface-wiping device in which there is provided an expressing means for expelling fluid from the wiper member that is actuable by a rod assembly secured to the utensil handle.

Such a surface-wiping device is disclosed by the German Utility Model Patent 88 00 887. In this device, a rod assembly is manipulated to force a wiping member, which is affixed to a holder, through two rollers, causing the wiping member to be compressed and thus causing the fluid it contains to be squeezed out. Unfortunately, this surface-wiping device has great many individual parts. Furthermore, the washing properties of this device are adversely influenced by its comparatively heavy weight and the irregular expression of fluid from the wiping member. The service life is substantially reduced because the wiping member is subject to considerable mechanical stresses and thus to wear and tear.

There remains a need for a surface wiping device that provides both excellent working properties over a long service life, and the rapid absorption of liquid into and the expression of liquid from the wiping member. There is a further need for such a device that is of rugged construction, requiring few parts.

SUMMARY OF THE INVENTION

The invention addresses this need by providing a surface wiping device that is rugged, requires few parts, and which offers a long and reliable service life. The surface wiping device is made of a handle that terminates at one end in a generally perpendicularly arranged holder, which may be pivoted with respect to the handle. The holder has two ends, and is spanned by a shaft. Attached to the holder at its ends and in spaced relation with the shaft is convexly shaped, adhesively backed generally cylindrical element. A compressible wiping member (e.g., a sponge) is attached to this adhesively backed convex surface, which is attached to the holder with the aid of a projecting retention part that mates with an opening on the holder. Fluid may be expressed from the wiping member by the manipulation of a roller that can be brought to bear on the wiping member by the action of a rod assembly associated with the handle.

As noted, the wiping member is affixed to a convexly shaped adhesive surface that surrounds a shaft. Liquid is expressed (i.e., squeezed out of) the moisture-absorbent wiping member by action of a pusher roller, which is swivelable around the shaft. The use of a convexly shaped adhesive surface assures that the wiping member can reliably be secured through its bonding to the adhesive surface along a broad contact area, which corresponds to the size of the adhesive surface. In this manner, excessive deformations of or damage to the wiping member that may arise when using such other attachment means as clamps or retaining claws are reliably avoided, which helps substantially prolong the service life of the surface-wiping device. The expressing means, which in one embodiment is a pusher roller, is movable around the shaft that is also surrounded by the convex sponge holding surface, and may squeeze out the entire surface of the wiping member facing the surface to be wiped, as needed. Furthermore, because the invention provides for the movement of the pusher roller onto the wiping member to be executed as a rolling-type movement of the former onto the latter, the expressing operation is gentle to the material of the wiping member. This significantly boosts the wiping member's service life.

According to one advantageous refinement, the wiping member can be a sponge. Depending upon the particular application and the surfaces to be wiped, different types of wiper-member materials can be attached, as needed, to the utensil handle, and be squeezed out by the swivel movement of the expression roller. The material of the sponge member may be of any type typically used for this purpose.

The clearance between the shaft and the expression roller can be variable. One advantage of such a construction is that with a given wiping-member thickness, the contact pressure of the expression roller against the wiping member is variable, or that, in dependence upon the particular conditions of the application, wiping members of different thicknesses can be used in the same surface-wiping device.

This construction, in which the adhesive surface can surround the shaft with equal clearance, or with a clearance which becomes increasingly larger in the moving direction of the expression roller, has several advantages. The adhesive surface can be appropriately formed to conform to the application case at hand. If the adhesive surface surrounds the shaft with equal clearance, then the wiping member will be squeezed out in a nearly uniform fashion when the expression roller is manipulated. The entire surface of the wiping member is then uniformly wetted and contains essentially the same moisture content. Where a different application requires that the wiping members be wetted to different degrees in sections, it has proven effective for the adhesive surface to surround the shaft with a clearance which becomes increasingly larger in the moving direction of the expression roller (the direction in which the roller is pivoted as it is brought to bear on the wiping member). When the rod assembly attached to the utensil handle in this version of the device is manipulated, the pressing roller swivels over the surface of the wiping member with a contact pressure which increases in the moving direction and, with increasing swiveling motion, squeezes out this wiping member more firmly. This refinement can be particularly advantageous when the surfaces to be wiped are soiled to different degrees, so that different amounts of water are needed for their cleaning, or when it is recommended for the surface to be cleaned to be immediately wiped again, following a relatively wet cleaning of the surfaces, with a substantially dry wiping member. To re-wipe the surfaces, all that one has to do is to use those surface areas which have been squeezed out to a greater degree.

To allow the displaced liquid to be removed more quickly, the adhesive surface can be penetrated by drainage holes. When the expression roller is manipulated, the displaced liquid is drained off, on the one hand, over the surface of the wiping member facing the expression roller and, on the other hand, through the drainage holes in the adhesive surface. Of course, one must take care, when dimensioning the drainage holes, to allow the expression roller to retain ample contact pressure against the wiping member. The adhesive surface can form a boundary surface for a retention part, which is detachably secured to a holder connected to the utensil handle. In this case, the retention part can simply be replaced without having to replace the utensil handle and the rod assembly that are required for manipulation. The ability to detachably fix the holder to the utensil handle is economically and environmentally advantageous.

According to one further advantageous refinement, the retention part and the holder can be snapped together. In this manner, a used wiping member can be easily and quickly replaced.

According to another advantageous refinement, the holder and the utensil handle are pivoted to one another by means of an articulated joint. This articulated joint between the holder and the utensil handle makes it possible to reach and clean hard-to-reach surfaces (e.g., corners), or under heavy furniture, such as cabinets.

To simplify the handling of the surface-wiping device of the invention, the articulated joint can be constructed so that it can be locked in at least two different swivel positions. To wipe surfaces which are easily accessible, the wiping member can extend, for example, at right angles to the utensil handle of the surface-wiping device and be locked in this position. To make it easier to clean surfaces which are not as wide as the wiping member when it is arranged at right angles to the utensil handle, the wiping member can be swiveled to extend essentially parallel to the utensil handle and locked in this position.

The expression roller can be supported in a swivel support, which can swing around the axle and be manipulated by the rod assembly. This provides excellent operational reliability and good working properties.

As noted above, the adhesive surface may be penetrated by drainage holes. To further improve the drainage of the water that has accumulated in the wiping member, it has proven to be advantageous during the expressing operation for the expression roller to have a surface that is penetrated by drainage holes. It is economically expedient to separate the drainage holes from one another, for example, by ribs which extend in the circumferential direction of the expression roller. It turns out to be quite simple to manufacture pressing rollers of such a design when, for example, annular discs having the same inside diameter, but deviating outside diameters, are alternately threaded onto the shaft. The drainage hole enables the wiping member to be effectively expressed and the expressed liquid to be quickly removed. In another embodiment, the expression roller can have a one-piece design.

With respect to having an economical and simple production of the surface-wiping device according to the invention, the expression roller can be supported at ends in the swivel support. To prevent the expression roller from undergoing deformation, as can happen when the wiping members are very wide, and to reduce the bearing loads in the vicinity of the axial ends of the pressing roller, the expression roller can be supported between its ends in at least one additional place in the swivel support.

Within the scope of a preferred specific embodiment, the expression roller can have a radius that is approximately 0.3 to 0.6 times as great as the largest radius of the adhesive surface. The diameter of the expression roller, which is small compared to the adhesive surface, makes it possible for the surface of the wiping member being used to retain its flexibility over a long service life. The good flexing work of the expression roller reliably prevents the surface of the wiping member from partially hardening and prevents caking, which also helps the wiping member retain its elasticity and other working properties across a long service life.

BRIEF DESCRIPTION OF THE DRAWINGS

These and other features, aspects, and advantages of the present invention will become better understood with regard to the following description, appended claims, and accompanying drawings, where:

DETAILED DESCRIPTION DRAWINGS

Figure 1:
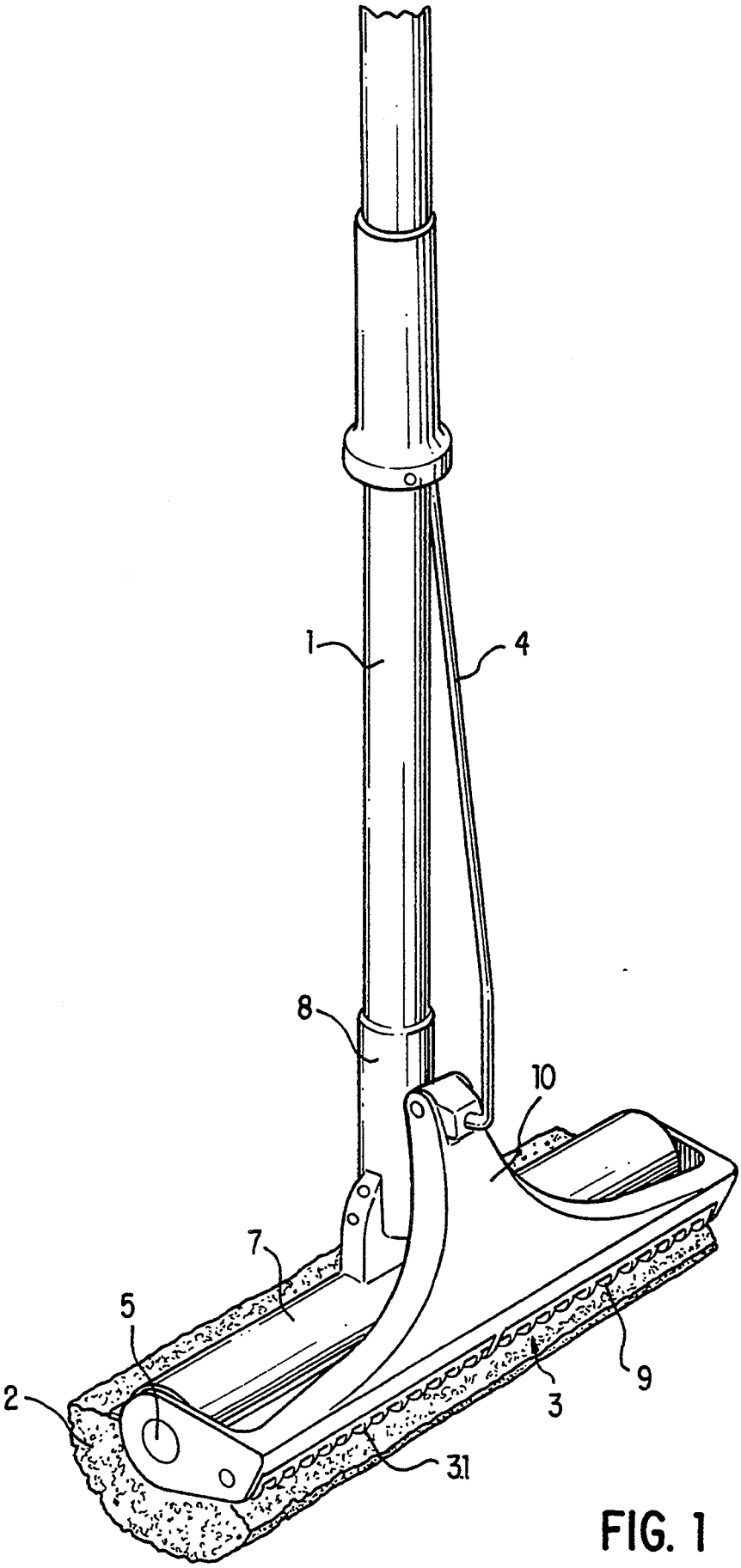
FIGS. 1 and 2 provide perspective views of a version of the surface-wiping device constructed according to the invention.
Figure 2:
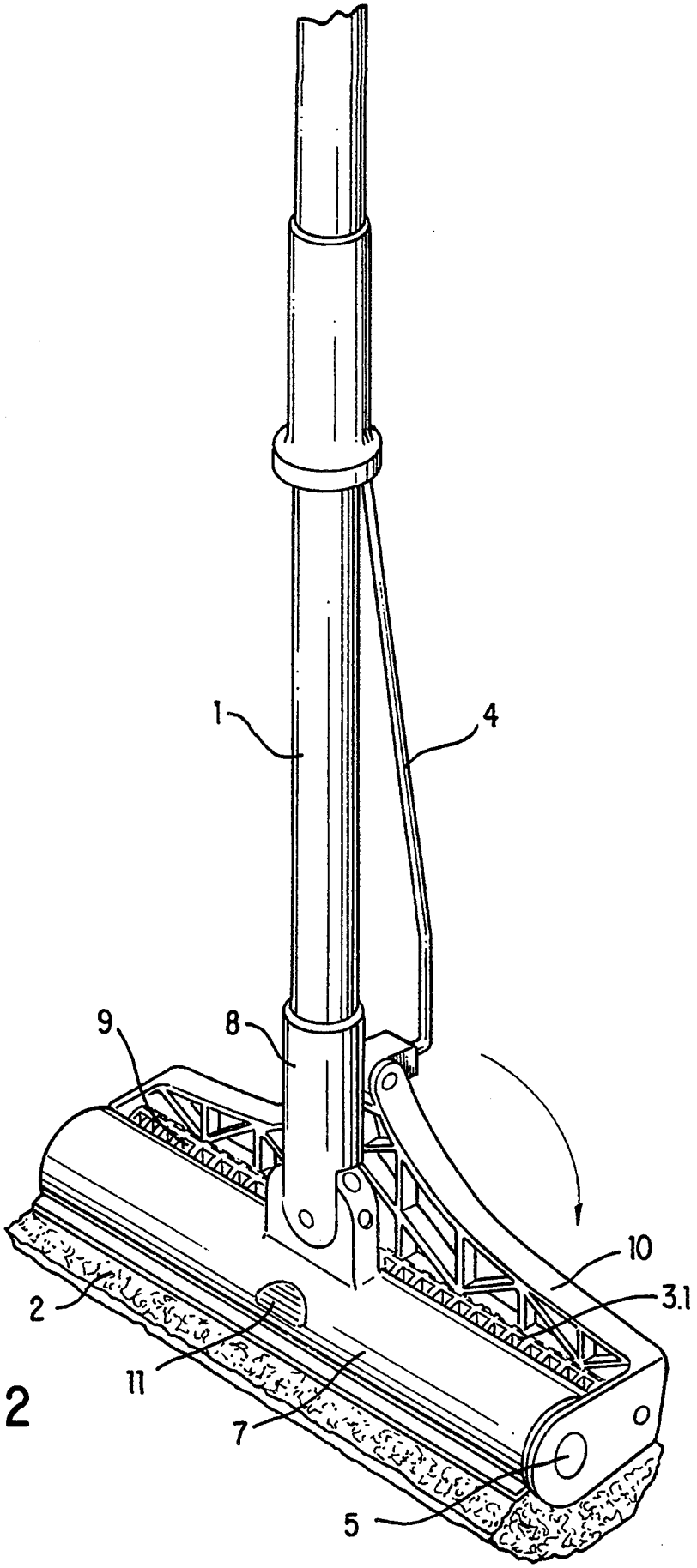

FIGS. 1 and 2 depict an embodiment of the surface-wiping device constructed according to the principles of the invention. The invention comprises a utensil handle 1, preferably made of plastic, which is connected at its axially lower end to an articulated joint 8. A holder 7, into which a retention part 11 can be snapped, is arranged on the side of the articulated joint 8 facing away from the utensil handle 1. On the opposite side in the holder 7, the retention part 11 is provided with an adhesive surface 6, to which is secured a compressible wiping member 2 that is made of an absorbent material. The advantage of inserting the retention part 11 in the holder 7 with a snap-in-type fastening is that the wiping member can be quickly and easily replaced when it is used up. In the present example, the wiping member 2 has an essentially semicircular cross-section and is affixed on the side facing the shaft 5 to a convex adhesive surface 6 of the retention part 11.

A fluid expression means 3 in the form of an expression roller 3.1 is provided to express the wiping member 2. This expression roller is pivoted in a swivel support 10 around its own shaft. The swivel support 10 essentially has a U-shape design and is rotatably supported around the shaft 5 in the area of its two projections. To introduce a sluing motion, the swivel support 10 is connected to the rod assembly 4, whereby the rod assembly 4 and the swivel support 10 can be manipulated by a sleeve surrounding the utensil handle 1. As depicted in this embodiment, it can be that in its starting position, the expression roller 3.1 does not contact the wiping member 2. Alternatively, the expression roller 3.1 may be attached so that it is always in contact with a portion of the wiping member 2. In this case, it is advantageous that the shear forces acting on the supporting surface 6 of the retention part 11 be reduced when the expression roller 3.1 is manipulated. Also, the mechanical loading of the wiping member 2 is reduced, thus guaranteeing a comparatively prolonged service life.

Figure 3:
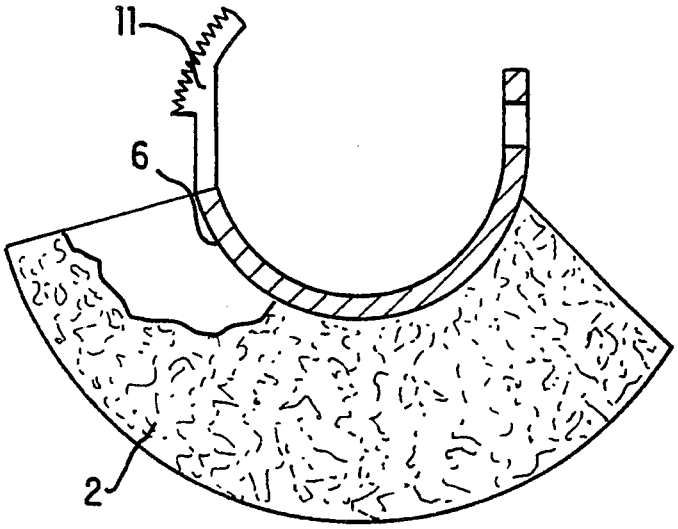
FIG. 3 illustrates in cross-section the retention part with a wiping member affixed to its adhesive surface.

FIG. 3 more fully illustrates the retention part 11. It consists of polystyrene and, on one part of its peripheral surface, comprises an adhesive surface 6 for the wiping member 2. The snap-in connection between the retention part 11 and the holder 7 is made up of the cut-out in the holder 7 (see FIG. 2) and the corresponding lug of the retention part 11, which snaps into this cut-out. The adhesive surface 6 of the retention part 11 surrounds the axle 5 with equal clearance, so that given a wiping member 2 of an equal thickness, a uniform expression of fluid from the wiping member is provided when the expression roller is swivelled.

Figure 4:
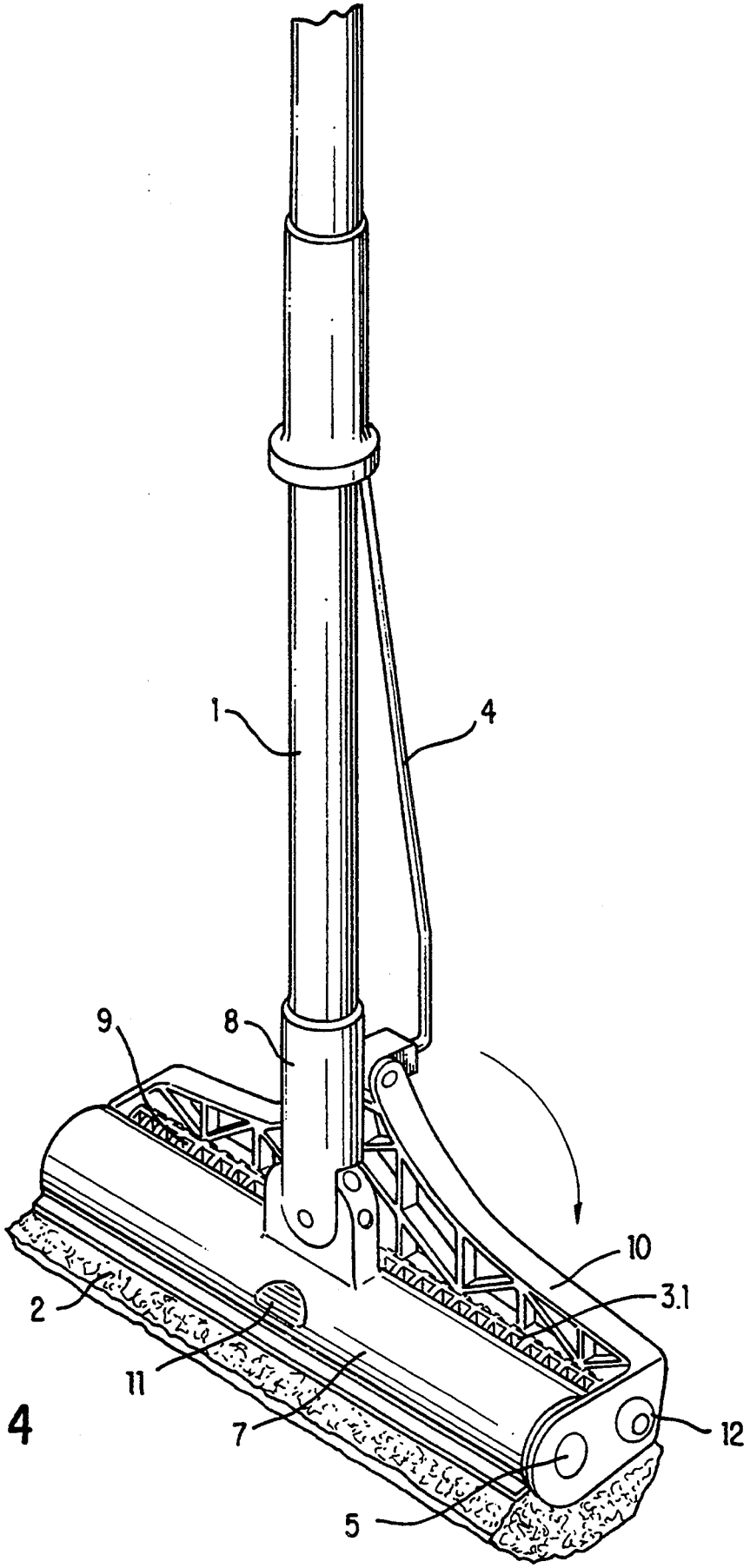
FIG. 4 is a perspective view of an additional embodiment of the invention, in which a cam is employed to provide a variable clearance between the expression roller and the wiping member.
Figure 5:
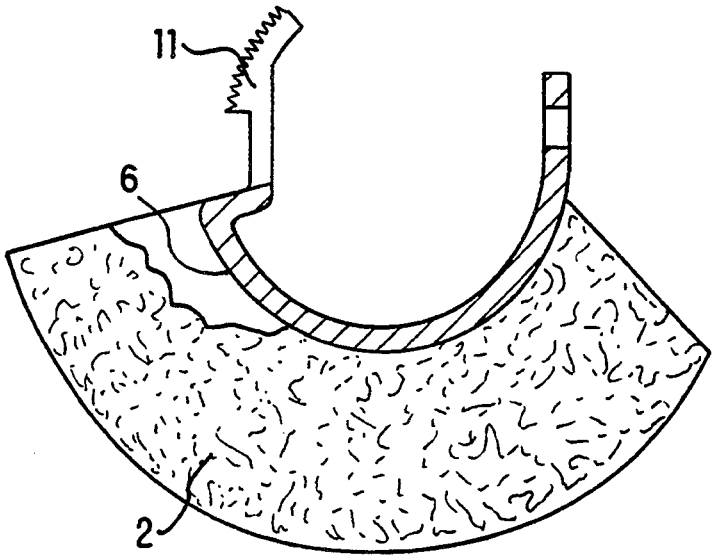
FIG. 5 is a cross-sectional view similar to FIG. 3, in which the wiping member surrounds the axle at a distance that varies with angular position.
Figure 6:
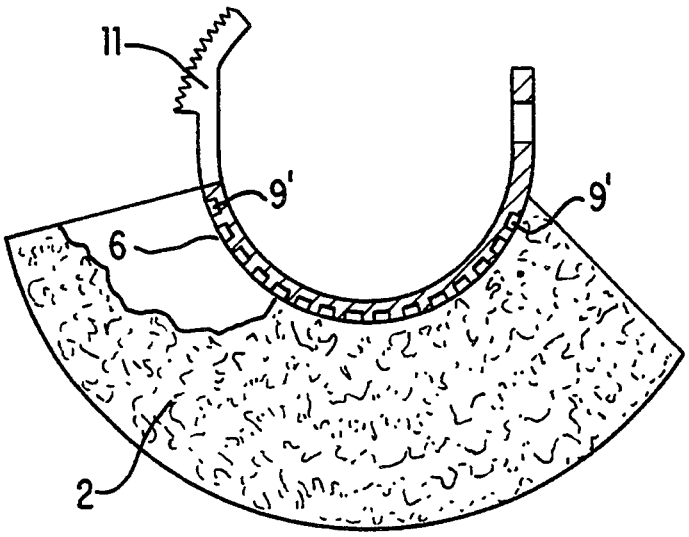
FIG. 6 is a cross-sectional view similar to FIG. 3, illustrating the use of drainage holes.
Figure 7:
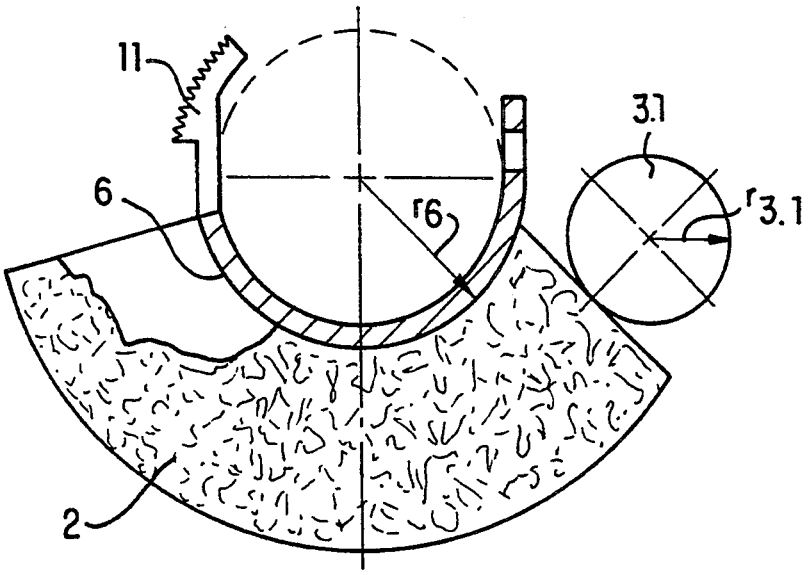
FIG. 7 is a cross-sectional view similar to FIG. 3, illustrating the relative curvatures of the expression roller and adhesive surface in one particular embodiment.

In another version, the clearance between the axle 5 and the axis of rotation of the expression roller 3.1 can be variable, making it possible to better adapt the device to the application in question. This can be achieved quite simply by using a cam 12 (FIG. 4). The clearance can also be made variable by modifying the convex adhesive surface so that it surrounds the axle 5 at a distance that varies with the angular position of the expression roller (FIG. 5). To achieve particularly good working properties, holder 7 may be swivel-mounted onto the utensil handle 1 by means of the articulated joint 8.

To provide improved drainage of the liquid, which is squeezed out of the wiping member 2, the expression roller 3.1 and the adhesive surface 6 are penetrated by drainage holes 9 and 9', respectively.

To provide a surface-wiping device with the lowest possible weight and a corresponding degree of handling ease, polypropylene is predominantly used as the material. Those elements which are subjected to greater mechanical stress may further be provided with fiber reinforcing. One possible material consists, for example, of 70% polypropylene with a 30% fiberglass component. The use of plastics provides excellent functional reliability over the entire service life of the device, since plastics are not subject to corrosion.

What is claimed is:

1. A surface-wiping device, comprising:

a utensil handle;

a holder that is connected to the utensil handle;

a convex adhesively backed surface that is connected to the utensil handle via the holder;

a shaft located between said holder and said adhesively backed surface;

a compressible wiper member consisting of an absorbent material that is affixed to the convex adhesive surface; and expressing means for removing fluid from the compressible wiper member, said expressing means being manipulable by a rod assembly secured to the utensil handle and further including an expression roller that is rotatable about an axis of rotation which spans the wiper member and said holder.

2. A surface-wiping device, comprising:

a utensil handle;

a holder that is connected to the utensil handle;

a convex adhesively backed surface that is connected to the utensil handle via the holder;

a shaft located between said holder and said adhesively backed surface;

a compressible wiper member consisting of an absorbent material that is affixed to the convex adhesive surface; and expressing means for removing fluid from the compressible wiper member, said expressing means being manipulable by a rod assembly secured to the utensil handle and further including an expression roller that is rotatable about an axis of rotation which spans the wiper member and said holder, wherein the clearance between the shaft and the expression roller is variable.

3. The surface-wiping device according to claim 1, wherein the wiping member comprises a sponge.

4. The surface-wiping device according to claim 1, wherein the adhesive surface surrounds the shaft with a uniform clearance.

5. The surface-wiping device according to claim 1, wherein the adhesive surface surrounds the shaft with a clearance which becomes increasingly larger in the direction in which the expression roller may be moved from its initial resting position.

6. The surface-wiping device according to claim 1, wherein the adhesive surface is penetrated by drainage holes.

7. The surface-wiping device according to claim 1, wherein the adhesive surface forms a boundary surface for a retention part, said retention part being detachably secured to the holder that is connected to the utensil handle.

8. The surface-wiping device according to claim 7, wherein the retention part and the holder can be snapped together.

9. The surface-wiping device according to claim 7, wherein the holder and the utensil handle are pivotally connected to one another by a joint.

10. The surface-wiping device according to claim 9, wherein the joint can be locked in at least two different swivel positions.

11. The surface-wiping device according to claim 1, wherein the expression roller is supported in a swivel support that is rotatable about the shaft by movement of the rod assembly.

12. The surface-wiping device according to claim 1, wherein the expression roller has a surface that is penetrated by drainage holes.

13. The surface-wiping device according to claim 12, wherein the drainage holes are separated from one another by ribs, which extend in the circumferential direction of the expression roller.

14. The surface-wiping device according to claim 11, wherein the expression roller is supported at its ends in the swivel support.

15. The surface-wiping device according to claim 14, wherein the expression roller is supported between its ends in at least one additional place in the swivel support.

16. The surface-wiping device according to claim 1, wherein the expression roller has a radius 0.3 to 0.6 times as great as the largest radius of the convex adhesive surface.

* * * * *